US007257916B2

(12) United States Patent
Hall et al.

(10) Patent No.: US 7,257,916 B2
(45) Date of Patent: Aug. 21, 2007

(54) DISPLAY APPARATUS FOR PLUSH ITEMS

(75) Inventors: Michael J. Hall, Kirkland, WA (US); Timothy A. Hall, Kirkland, WA (US)

(73) Assignee: Quixote Design, Inc., Seattle, WA (US)

( * ) Notice: Subject to any disclaimer, the term of this patent is extended or adjusted under 35 U.S.C. 154(b) by 0 days.

(21) Appl. No.: 11/244,889

(22) Filed: Oct. 6, 2005

(65) Prior Publication Data

US 2006/0026872 A1 Feb. 9, 2006

Related U.S. Application Data

(63) Continuation of application No. 10/683,746, filed on Oct. 10, 2003, now Pat. No. 7,047,678.

(51) Int. Cl.
*B65D 69/00* (2006.01)

(52) U.S. Cl. ..... 40/672; 40/642.01; 206/806; 5/636

(58) Field of Classification Search ..... 40/672, 40/642.01, 665; 206/806, 417, 278; 5/636, 5/492, 496; 229/87.02

See application file for complete search history.

(56) References Cited

U.S. PATENT DOCUMENTS

| | | | | |
|---|---|---|---|---|
| 2,412,769 | A | | 12/1946 | Easterbrooks |
| 2,869,720 | A | | 1/1959 | Mahoney |
| 2,983,310 | A | | 5/1961 | Warlick et al. |
| 3,044,517 | A | | 7/1962 | Levi |
| 3,346,892 | A | | 10/1967 | DuPriest |
| 3,959,834 | A | | 6/1976 | Hunt |
| 4,014,436 | A | * | 3/1977 | Tunis ..... 206/494 |
| 4,048,675 | A | | 9/1977 | Griffin |
| 4,131,198 | A | | 12/1978 | Fischer |
| 4,214,541 | A | | 7/1980 | Zeigler, Jr. et al. |
| 4,224,883 | A | | 9/1980 | Zeigler, Jr. et al. |
| D262,442 | S | * | 12/1981 | Bressler et al. ..... D10/76 |
| 4,477,515 | A | | 10/1984 | Masuda et al. |
| 4,619,864 | A | | 10/1986 | Hendrix et al. |
| 4,624,198 | A | | 11/1986 | Beam et al. |
| 4,784,248 | A | | 11/1988 | Workman |
| 4,856,439 | A | | 8/1989 | O'Neal et al. |
| 4,893,574 | A | | 1/1990 | O'Neal et al. |
| 4,896,387 | A | | 1/1990 | Malcolm et al. |
| 4,930,173 | A | | 6/1990 | Woller |
| 5,038,691 | A | | 8/1991 | Boser |
| 5,070,558 | A | | 12/1991 | Fenley |
| 5,127,117 | A | | 7/1992 | Bridges |
| 5,187,825 | A | | 2/1993 | Tesch |

(Continued)

FOREIGN PATENT DOCUMENTS

| | | | |
|---|---|---|---|
| JP | 09294895 | A | 11/1997 |

(Continued)

*Primary Examiner*—Cassandra Davis
(74) *Attorney, Agent, or Firm*—Fredrikson & Byron P.A.

(57) ABSTRACT

Methods and apparatus for displaying plush items are disclosed. A display apparatus in accordance with an exemplary embodiment of the present invention comprises a column and a strap extending between the top end of the column and the bottom end of the column. The column and the strap cooperate to define an aperture. The aperture may be dimensioned to received a plush item (e.g., a pillow).

20 Claims, 12 Drawing Sheets

U.S. PATENT DOCUMENTS

| | | | | |
|---|---|---|---|---|
| 5,228,158 | A | 7/1993 | Park | |
| 5,256,236 | A | 10/1993 | Woller | |
| 5,299,333 | A | 4/1994 | Pedersen et al. | |
| 5,333,563 | A | 8/1994 | Yamanoi | |
| 5,408,712 | A | 4/1995 | Brun | |
| 5,459,894 | A | 10/1995 | Buonocore | |
| 5,513,585 | A | 5/1996 | Diekmann et al. | |
| 5,528,781 | A | 6/1996 | Suzuki et al. | |
| 5,540,167 | A | 7/1996 | Mussig et al. | |
| 5,557,816 | A | 9/1996 | Pedersen et al. | |
| 5,678,262 | A | 10/1997 | Tomlinson | |
| 5,718,010 | A | 2/1998 | Beier | |
| 5,727,266 | A | 3/1998 | Pang | |
| 5,802,644 | A | 9/1998 | Scheurer | |
| 5,843,556 | A | 12/1998 | Levas | |
| 6,009,579 | A | 1/2000 | Pedersen | |
| 6,025,041 | A | 2/2000 | Reuben | |
| 6,038,720 | A | 3/2000 | Matthews et al. | |
| 6,230,349 | B1 | 5/2001 | Silver et al. | |
| 6,301,730 | B1 | 10/2001 | Delfs et al. | |
| 6,439,386 | B1 * | 8/2002 | Sauer et al. | 206/494 |
| 6,618,881 | B2 | 9/2003 | Hart et al. | |
| 6,640,977 | B2 | 11/2003 | Matthews Brown et al. | |
| 6,685,024 | B1 | 2/2004 | Matthews | |

FOREIGN PATENT DOCUMENTS

| | | | |
|---|---|---|---|
| JP | 09322998 | A | 12/1997 |

* cited by examiner

DISPLAY APPARATUS FOR PLUSH ITEMS

This application is a continuation-in-part of U.S. application Ser. No. 10/683,746, filed Oct. 10, 2003, now U.S. Pat. No. 7,047,678.

FIELD OF THE INVENTION

The present invention relates generally to point-of-sale packaging. More particularly, the present invention relates to point-of-sale packaging for compressible or plush items (e.g., pillows, plush toys, knit apparel, and the like).

BACKGROUND OF THE INVENTION

Various devices exist that aid in the display of goods for retail sale, and particularly that aid in the display of soft goods such as plush toys, pillows, towels, and apparel items. In order to optimally display a soft good, such as a plush toy, pillow, towel, apparel item, or the like, it is preferable to display the item in an attractive way, and permit the tactile examination of the item by the consumer prior to sale. It is also preferable to provide a display system to minimize shelf space taken up by the item, for example by hanging if possible, and provide a system by which, if a potential consumer removes the item from the packaging in order to examine the product, the replacement of the product within the packaging can be accomplished without undue inconvenience by the consumer, or perhaps more typically, retail staff. Such repackaging or resetting of the display modality will preferably not be obtrusive or objectionable to later potential purchasers of the particular instance of the good—that is, later consumers will preferably not reject the good that has been repackaged or subject to a reset display modality as being "already opened" and thus tainted by handling by others not concerned with maintaining the quality of the product. As a result, such violated items must often be returned to the manufacturer or sold at a substantial discount.

In addition, the retail packaging or display modality will preferably reduce the need or desire of the consumer to remove the packaging or display modality in order to examine the retail item—in other words, the consumer will preferably be able to make a decision whether to purchase the item without disturbing the display modality or packaging. Tactile examination, i.e, the "feel" or "touch" of soft goods is important to the consumer. Many soft goods are designed and purchase to provide comfort to the user, so that the feel of the product on the users skin is of paramount importance in the purchasing decision. The "feel" of a product is not limited to its surface feel. The degree to which the product is subject to compression, its resilience against such compression, it re-expansion following such compression, and other qualities relating to cushioning is of importance to the consumer, particularly when the item is a pillow or plush toy. It is also a key consideration of any display modality that the modality itself will not cause the good to be damaged, even in cases of rough handling by the consumer.

While packaging of soft goods in boxes or shrink wrapped in clear plastic provide protection to the soft good, when consumers violate this packaging in order to tactilely examine an item, it is often obvious to later consumers that the packaging has been violated, making the particular instance of the product (the individual item) more difficult to sell to later consumers. Shrink wrap, in addition to preventing surface feel examination, often interferes with an examination of the compression feel of an item, for example because the item is compressed as part of the shrink-wrapping process. In addition, boxes and shrink-wrapped packages typically require additional shelf space in comparison to display modalities in which the product is hung, for example on a rod mounted on shelf backing and pointed towards the consumer. This hanging-based display modality makes better use of space and requires less hardware (esp. shelving) than providing shelf-based display.

Commonly, hang tags are used as a retail display modality that reduces shelf space required for display of an item. These may be of several types. For example, a fabric loop or plastic D-shaped ring or O-shaped ring may be sewn into the item, preferably in a strong or reinforced location on the item, such as a seam or corner. These may be subject to rough handling, however, by consumers who are not concerned with the quality of the item, and this may cause tearing or other imperfections at the joinder of the loop or ring to the item.

Another popular hanging modality is a plastic ring having a T-extension, the T-extension being inserted through the fabric of the item with a device adapted to this purpose (a hang-tag gun), with the inserted T-extension serving as an anchor for the ring. In the event of non-woven fabrics such as vinyl, insertion of such a tag requires a hole to be made in the fabric. Even with woven fabrics, the hole required may be larger than holes naturally occurring in the weave. In addition to causing strain on the fabric at the point of anchoring, the T-extension may be subject to tearing out, causing tearing of the fabric. Even after purchase, when the ring is no longer required, when the end consumer cuts the ring off, the T-extension is left in the item. The tail of this T-extension may protrude from the item through the fabric, and may scratch the user's face or otherwise cause user discomfort, particularly with pillows or plush toys. Similar methods involving the use of plastic T-anchors are used to attach an item to a hanging card backer or other display type, with similar deleterious effects on the item to be displayed.

There is, accordingly, a need for a packaging or display modality goods and particularly for soft or compressible goods and particularly for items such as pillows, plush toys, towels, and apparel items, sometimes collectively referred to herein as "plush" or "plush goods" that allows for display of the item taking up minimal shelf space (preferably by hanging display), and allows for tactile examination of the surface feel and compression feel by the end consumer without disruption or violation of the packaging by the consumer. The packaging or display modality should not cause damage to the item, or cause a weakness to the item or a possible point of damage in the event of rough handling. It is also desirable that the display modality can be removed completely by the consumer, with none of the modality left in the product.

SUMMARY OF THE INVENTION

The present invention relates generally to point-of-sale packaging for retail goods. More particularly, the present invention relates to point-of-sale packaging for plush items (e.g., pillows, plush toys, knit apparel, and the like). A display apparatus in accordance with an exemplary embodiment of the present invention comprises a column and a strap extending between the top end of the column and the bottom end of the column. The column and the strap cooperate to define an aperture. The aperture may be dimensioned to received a plush item (e.g., a pillow).

In one aspect of an exemplary embodiment of the present invention a first uncovered portion of the plush item extends beyond a first side of the display apparatus and a second uncovered portion of the plush item extends beyond a second side of the display apparatus. The first uncovered portion and the second uncovered portion are not covered by the display apparatus. Accordingly, the first uncovered portion and the second uncovered portion are available for visual and tactile examination. For example, a consumer considering the purchase of the plush item can squeeze it and evaluate its resilience against compression. Another quality relating to cushioning.

The display apparatus covers a covered portion of the plush item. In same advantageous embodiments, the first uncovered portion has a surface area that is greater than a surface area of the covered portion. Also in some advantageous embodiments, the second uncovered portion has a surface area that is greater than the surface area of the covered portion.

In some useful embodiments of the present invention, the aperture is dimensioned to receive the plush item when the plush item is assuming a compressed shape. Once the plush item is disposed within the aperture, it may be allowed to assume an expanded shape. When the plush item expands, it may press against the column and the strap of the display apparatus.

In some useful embodiments of the present invention, the strap and the column are capable of providing restraining forces that are substantially equal and opposite to expansion forces created by the plush item as it seeks to return to a relaxed, expanded shape. The plush item and the strap may meet one another at a first interface. Similarly, the plush item and the column may meet one another at a second interface. The expansion of the plush item and the restraining forces provided by the display apparatus may facilitate the production of one or more friction forces at the first interface and the second interface. These friction forces may advantageously resist relative movement between the plush item and the display apparatus. In some useful embodiments of the present invention, the aperture of the display apparatus is dimensioned such that the combined magnitude of one or more friction forces is greater than the weight of the plush item. When this is the case, these friction forces may prevent the plush item and the display apparatus from separating during handling.

In some embodiments of the present invention, friction at the interfaces between the plush item and the display apparatus is the sole means of fixing the plush item relative to the display apparatus. When this is the case, the plush item can be easily and non-destructively separated from the display apparatus by urging the plush item to assume a more compressed shape and withdrawing the plush item from the aperture of the display apparatus. For example, a consumer considering the purchase of the plush item can remove the plush item from the display apparatus. When the evaluation is complete, the plush item can be urged into a more compressed shape and reinserted into the aperture of the display apparatus.

In some useful embodiments of the present invention, the column provides a convenient means for grasping the combined display apparatus and plush item. In some cases, for example, a width of the column is selected such that the column can be received between the thumb and forefinger of a human hand. Also in some cases, the column may include a side panel that has sufficient surface area to receive a human thumb when the column is gripped between the thumb and forefinger. Additionally, the column may include a second side panel that has sufficient surface area to receive one or more fingers.

DETAILED DESCRIPTION

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
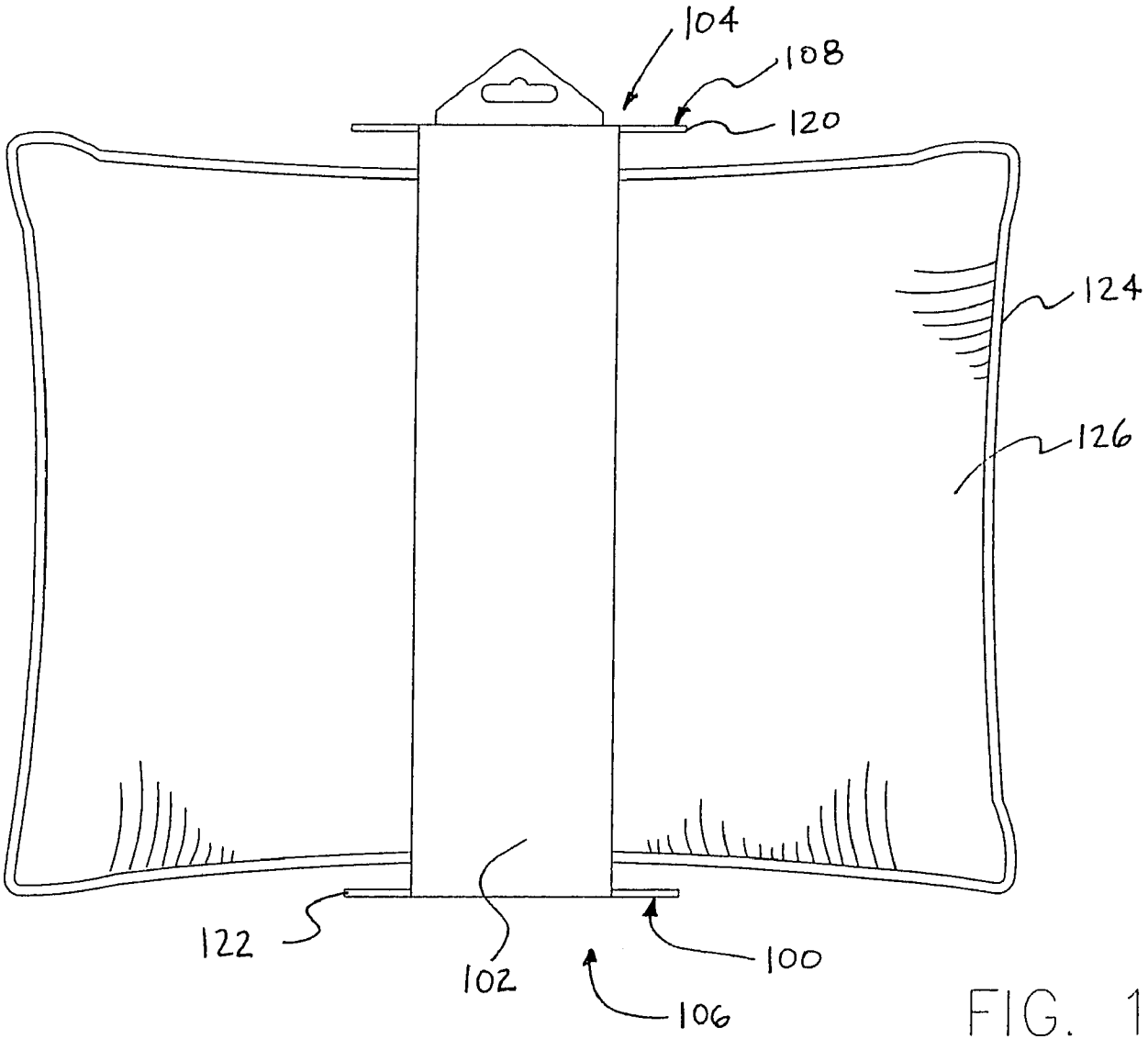
FIG. 1 is a front view showing a display apparatus in accordance with an exemplary embodiment of the present invention.

FIG. 1 is a front view showing a display apparatus 100 in accordance with an exemplary embodiment of the present invention. Display apparatus 100 comprises a column 102 having a top end 104 and a bottom end 106. A strap 108 of display apparatus 100 extends between top end 104 of column 102 and bottom end 106 of column 102. In the embodiment of FIG. 1, strap 108 comprises a top panel 120, a bottom panel 122 and a messial panel (not visible in FIG. 1) that extends between top panel 120 and bottom panel 122.

Column 102 and strap 108 of display apparatus 100 cooperate to define an aperture. In FIG. 1, a plush item 124 is shown extending through the aperture of display apparatus 100. In the embodiment of FIG. 1, plush item 124 comprises a pillow 126.

Figure 2:
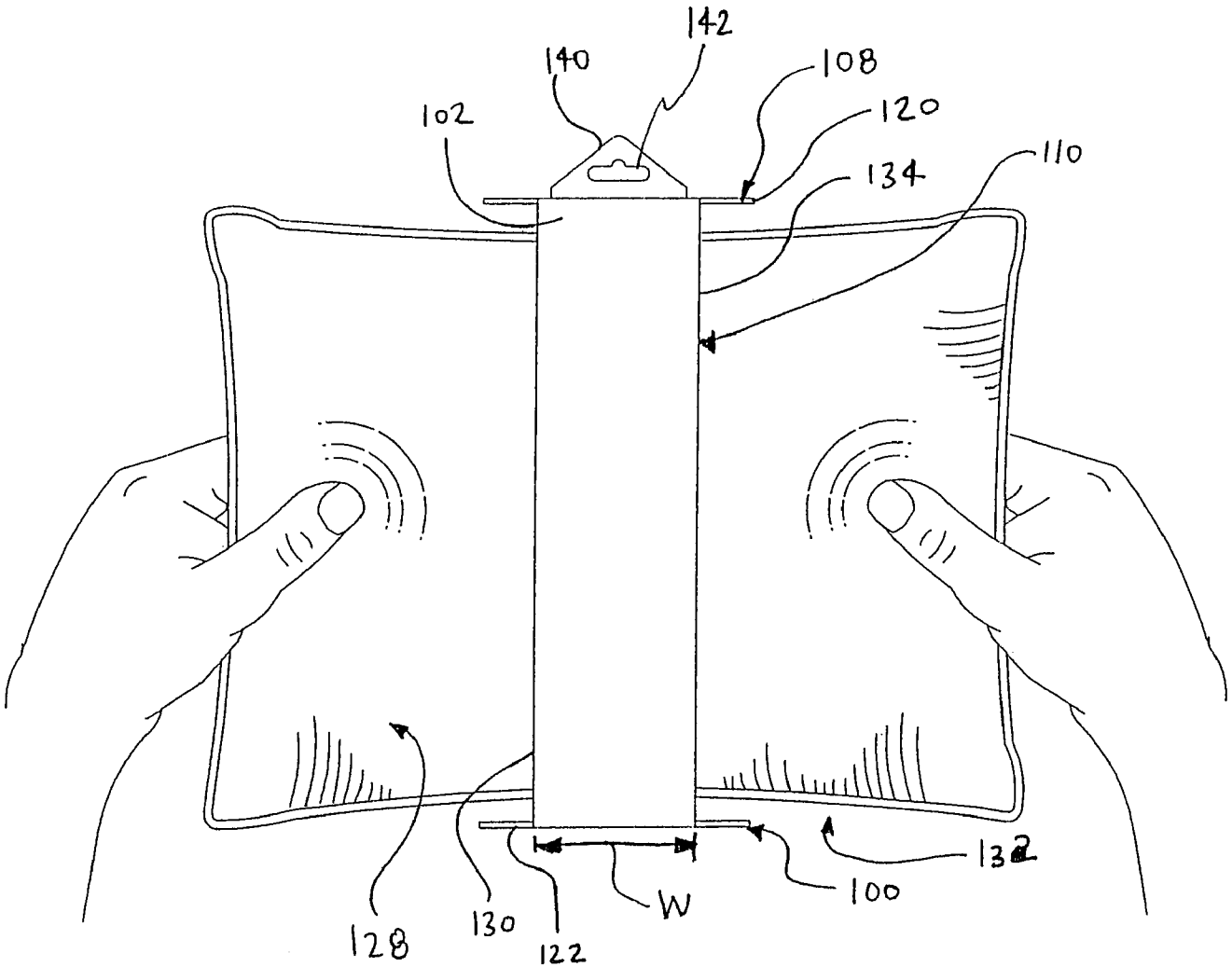
FIG. 2 is an additional front view including display apparatus shown in the previous figure.

FIG. 2 is an additional front view including display apparatus 100 shown in the previous figure. With reference to FIG. 2, it will be appreciated that a first uncovered portion 128 of pillow 126 extends beyond a first side 130 of display apparatus 100 and a second uncovered portion 132 of pillow 126 extends beyond a second side 134 of display apparatus 100. In the embodiment of FIG. 2, first uncovered portion 128 and second uncovered portion 132 are not covered by display apparatus 100.

With reference to FIG. 2, it will be appreciated that first uncovered portion 128 and second uncovered portion 132 of pillow 126 are available for visual and tactile examination. For example, a consumer considering the purchase of pillow 126 can squeeze pillow 126 to evaluate its resilience against compression and other qualities relating to cushioning. In FIG. 2, a first hand 136 is shown squeezing first uncovered portion 128 and a second hand 138 is shown squeezing second uncovered portion 132.

Display apparatus 100 of FIG. 2 comprises a column 102 and a strap 108. Strap 108 includes a top panel 120 and a bottom panel 122. In FIG. 2, a hang tab 140 is fixed to top panel 120. Hang tab 140 defines a hole 142. In FIG. 2, column 102 is shown covering a covered portion 110 of pillow 126. With reference to FIG. 2, it will be appreciated that first uncovered portion 128 has a surface area that is greater than a surface area of covered portion 110. With continuing reference to FIG. 2, it will be appreciated that second uncovered portion 132 also has a surface area that is greater than the surface area of covered portion 110. In the embodiment of FIG. 2, column 102 has a width W. With reference to FIG. 2, it will be appreciated that width W of column 102 is selected such that first uncovered portion 128 and second uncovered portion 132 both have a surface area that is greater than the surface area of covered portion 110.

Figure 3:
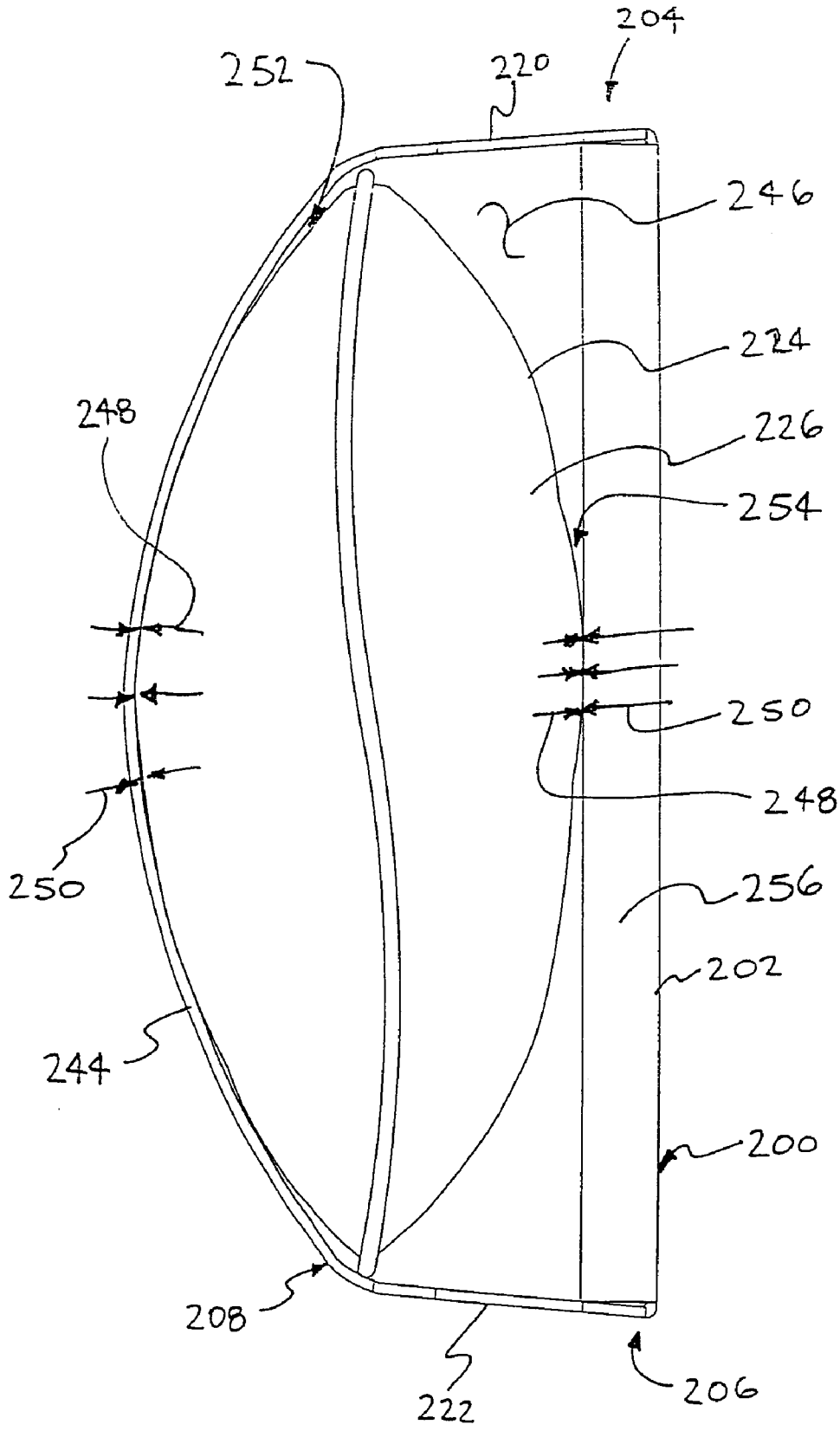
FIG. 3 is a side view showing a display apparatus in accordance with an exemplary embodiment of the present invention.

FIG. 3 is a side view showing a display apparatus 200 in accordance with an exemplary embodiment of the present invention. Display apparatus 200 comprises a column 202 and a strap 208. In FIG. 3, strap 208 is shown extending between a top end 204 of column 202 and bottom end 206 of column 202. In the embodiment of FIG. 3, strap 208 comprises a top panel 220, a bottom panel 222 and a messial panel 244.

With reference to FIG. 3, it will be appreciated that column 202 and strap 208 define an aperture 246 of display apparatus 200. In the embodiment of FIG. 3, a plush item 224 is shown extending through aperture 246. Plush item 224 comprises a pillow 226 in the embodiment of FIG. 3.

In some useful embodiments of the present invention, aperture 246 is dimensioned to receive pillow 226 when pillow 226 is assuming a compressed shape. Once pillow 226 is disposed within aperture 246, pillow 226 may be allowed to assume an expanded shape. When pillow 226 expands, it presses against column 202 and strap 208. A plurality of expansion forces 248 created by pillow 226 are illustrated with arrows in FIG. 3. A plurality of restraining forces 250 provided by strap 208 and column 202 are also illustrated using arrows in FIG. 3. In some useful embodiments of the present invention, strap 208 and column 202 are capable of providing restraining forces 250 that are substantially equal and opposite to expansion forces 248.

With reference to FIG. 3, it will be appreciated that pillow 226 and strap 208 meet one another at a first interface 252. With continuing reference to FIG. 3, it will be appreciated that pillow 226 and column 202 meet one another at a second interface 254. The expansion of pillow 226 and the restraining forces 250 provided by display apparatus 200 may facilitate the production of one or more friction forces at first interface 252 and second interface 254. These friction forces may advantageously resist relative movement between the pillow 226 and display apparatus 200. In some useful embodiments of the present invention, aperture 246 of display apparatus 200 is dimensioned such that the combined magnitude of the one or more friction forces is greater than the weight of pillow 226. When this is the case, these friction forces may prevent pillow 226 and display apparatus 200 from separating during handling.

In some embodiments of the present invention, friction at the interfaces between the pillow and the display apparatus is the sole means of fixing the pillow relative to the display apparatus. When this is the case, the pillow can be easily and non-destructively separated from the display apparatus by urging the pillow to assume a more compressed shape and withdrawing the pillow from the aperture of the display apparatus. For example, a consumer considering the purchase of a pillow can remove the pillow from the display apparatus. When the evaluation is complete, the pillow can be urged into a more compressed shape and re-inserted into the aperture of the display apparatus.

In the embodiment of FIG. 3, column 202 includes a side panel 256. In some useful embodiments of the present invention, side panel 256 has sufficient surface area to receive a human thumb, when column 202 is gripped between the thumb and one or more fingers.

Figure 4:
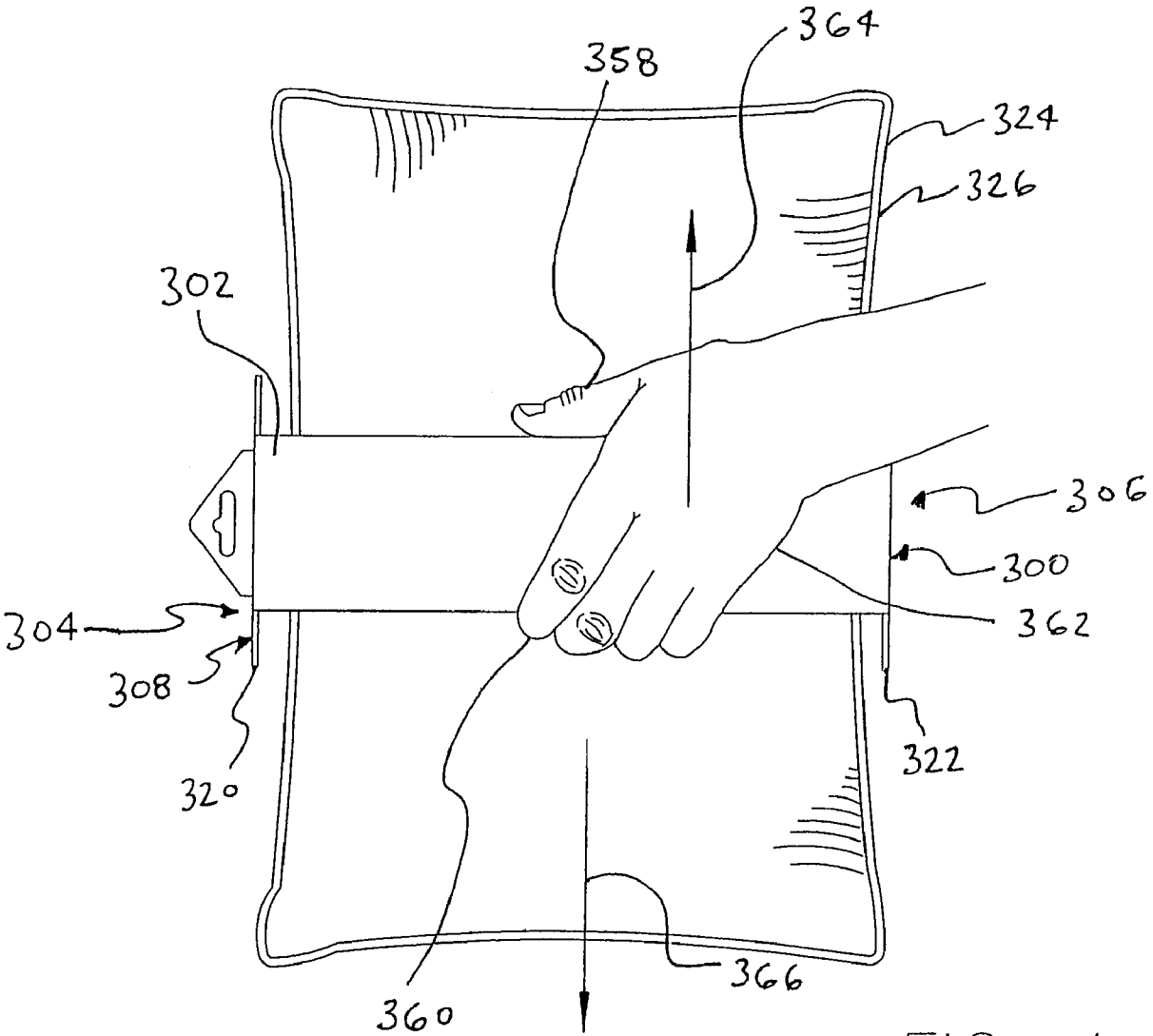
FIG. 4 is a front view showing a display apparatus in accordance with an exemplary embodiment of the present invention.

FIG. 4 is a front view showing a display apparatus 300 in accordance with an exemplary embodiment of the present invention. Display apparatus 300 includes a strap 308 comprising a top panel 320 and a bottom panel 322. With reference to FIG. 4, it will be appreciated that strap 308 extends between a top end 304 and a bottom end 306 of a column 302 of display apparatus 300.

In the embodiment of FIG. 4, column 302 is being gripped between a thumb 358 and a finger 360 of a hand 362. In FIG. 4, a supporting force 364 provided by hand 362 is illustrated using an arrow. In FIG. 4, a plush item 324 is shown extending through an aperture defined by strap 308 and column 302. In the embodiment of FIG. 4, plush item 324 comprises a pillow 326.

In some useful embodiments of the present invention, aperture 346 is dimensioned to receive pillow 326 when pillow 326 is assuming a compressed shape. Once pillow 326 is disposed within aperture 346, pillow 326 may be allowed to assume an expanded shape. When pillow 326 expands, it presses against column 302 and strap 308.

The expansion of pillow 326 and restraining forces provided by display apparatus 300 may facilitate the production of one or more friction forces at an interface between pillow 326 and display apparatus 300. These friction forces may advantageously resist relative movement between the pillow 326 and display apparatus 300.

In FIG. 4, a weight force 366 created by the weight of pillow 326 is illustrated using an arrow. In the embodiment of FIG. 4, aperture 346 of display apparatus 300 is dimensioned such that the friction force between display apparatus 300 and pillow 326 is capable of supporting the weight of pillow 326. Accordingly, the friction between display apparatus 300 and pillow 326 is sufficient to prevent pillow 326 from falling due to the effect of gravity in the embodiment of FIG. 4.

Figure 5:
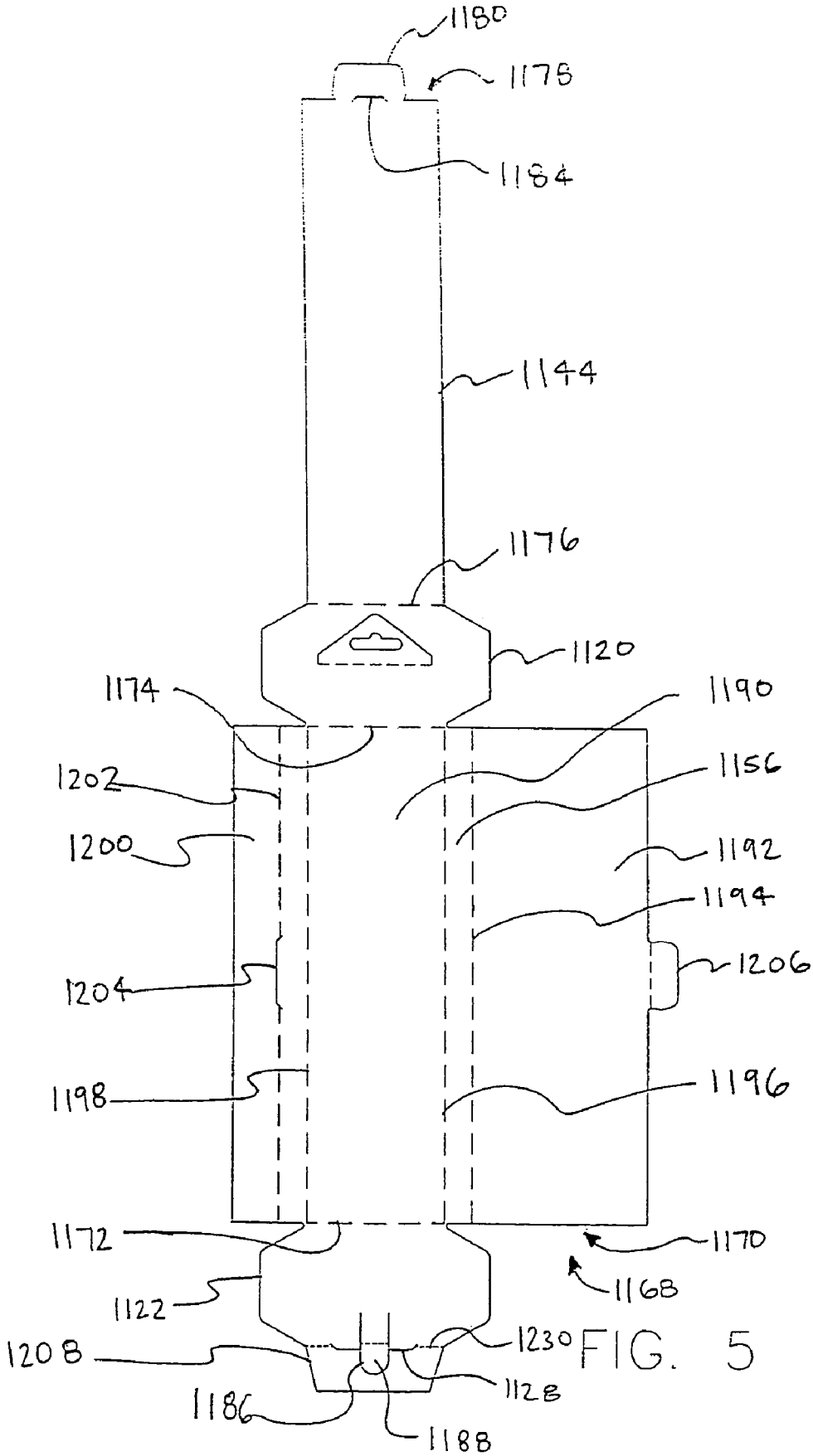
FIG. 5 is a plan view of a blank in accordance with an exemplary embodiment of the present invention.

FIG. 5 is a plan view of a blank 1168 in accordance with an exemplary embodiment of the present invention. Blank 1168 comprises a top panel 1120, a bottom panel 1122 and a column portion 1170 disposed between top panel 1120 and bottom panel 1122. Column portion 1170 and bottom panel 1122 are joined at a first fold line 1172. Column portion 1170 is also joined to top panel 1120 at a second fold line 1174.

Top panel 1120 is joined to a messial panel 1144 at a third fold line 1176. In some useful embodiments of the present invention, distal end 1178 of messial panel 1144 can be selectively coupled to bottom panel 1122 so that messial panel 1144, bottom panel 1122 and top panel 1120 form a strap. In the embodiment of FIG. 5, a first tab 1180 is disposed proximate distal end 1178 of messial panel 1144. Also in the embodiment of FIG. 5, bottom panel 1122 defines a first slot 1182. In some useful embodiments of the present invention, first tab 1180 and first slot 1182 are dimensioned such that first tab 1180 can be inserted into first slot 1182.

With reference to FIG. 5, it will be appreciated that messial panel 1144 defines a second slot 1184. Bottom panel 1122 includes a first cut 1186 that defines a second tab 1188. In some useful embodiments of the present invention, second tab 1188 and second slot 1184 are dimensioned so that a portion of second tab 1188 can be inserted into second slot 1184. In the embodiment of FIG. 5, distal end 1178 of messial panel 1144 can be coupled to bottom panel 1122 by inserting first tab 1180 into first slot 1182 and inserting second tab 1188 into second slot 1184. In this manner, a mechanically interlocking connection may be formed.

Column portion 1170 of blank 1168 comprises a first major panel 1190 and a second major panel 1192. A first side panel 1156 of column portion 1170 is disposed between first major panel 1190 and second major panel 1192. First side panel 1156 joins second major panel 1192 at a fourth fold line 1194. First side panel 1156 and first major panel 1190 join one another at a fifth fold line 1196. A second side panel 1157 is joined to first major panel 1190 at a sixth fold line 1198. Second side panel 1157 joins a column flap 1200 at an seventh fold line 1202.

Column portion 1170 of blank 1168 defines a third slot 1204. A third tab 1206 extends beyond one side of second major panel 1192. In the embodiment of FIG. 5, third tab 1206 and third slot 1204 are dimensioned such that third tab 1206 can be inserted into third slot 1204. Third tab 1206 can be inserted into third slot 1204, for example, when column portion 1170 is folded to form a column. In the embodiment of FIG. 5, a bottom flap 1208 joins bottom panel 1122 at an eighth fold line 1230.

Figure 6:
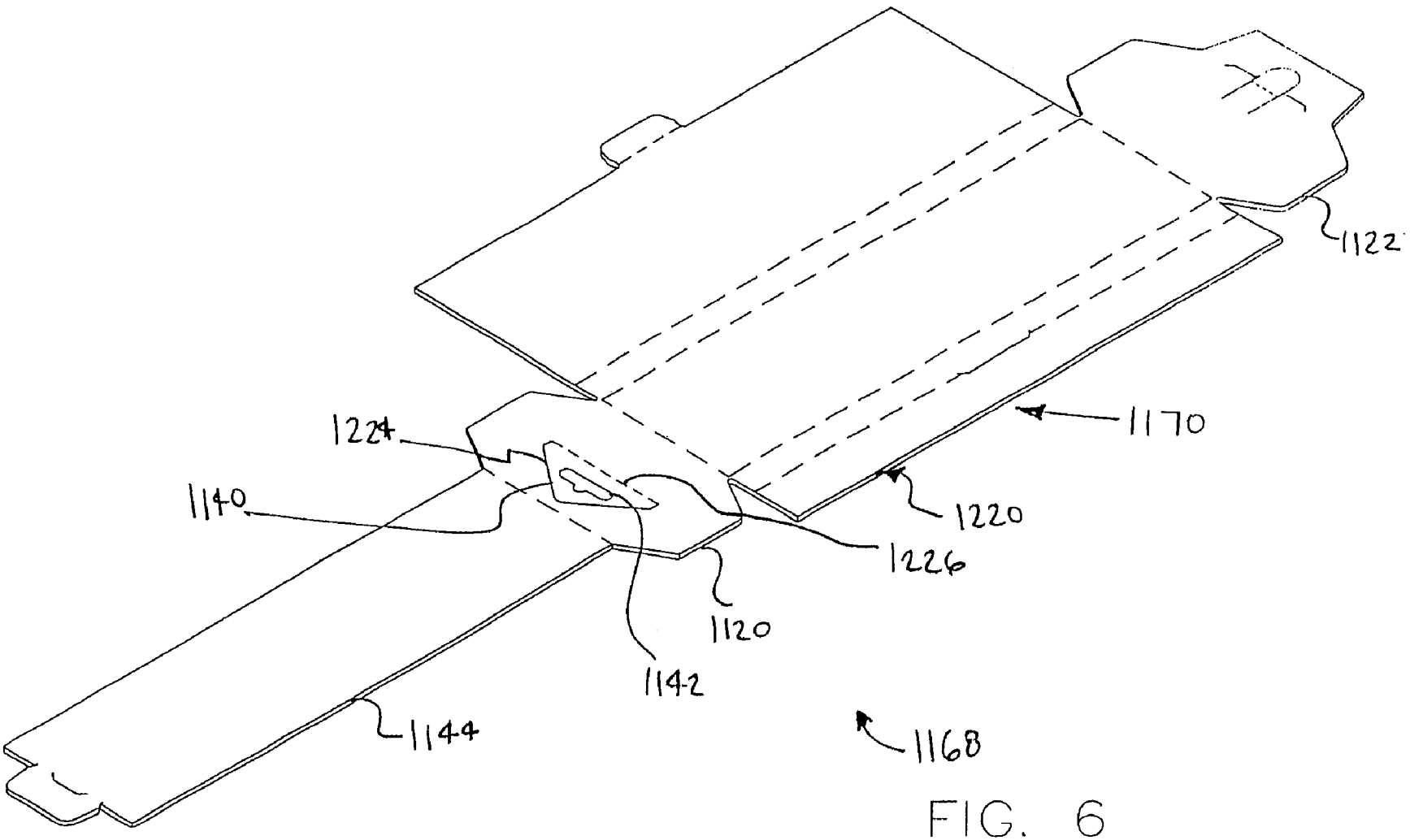
FIG. 6 is an isometric view of blank shown in the previous figure.

FIG. 6 is an isometric view of blank 1168 shown in the previous figure. With reference to FIG. 6 it will be appreciated that blank 1168 is formed from a single sheet 1220. Sheet 1220 may comprise various materials without deviating from the spirit and scope of the present invention. Examples of materials that may be suitable in some applications include corrugated paper, card stock, and plastic. One example of a plastic product that may be suitable in some application is COROPLAST corrugated plastic sheeting, available from Coroplast, Inc. of Dallas, Tex.

Blank 1168 of FIG. 6 comprises a column portion 1170, a messial panel 1144, a bottom panel 1122, and a top panel 1120. With reference to FIG. 6, it will be appreciated that top panel 1120 includes a second cut 1224 that defines a hang tab 1140. Hang tab 1140 defines a hole 1142. In FIG. 6, hang tab 1140 is shown hingingly connected to top panel 1120 at a ninth fold line 1226.

Several fold lines are illustrated using dashed lines in FIG. 6. In some useful embodiments of the present invention, each fold line comprises a localized area of weakness. Each localized area of weakness may comprise various elements without deviating from the spirit and the scope of the present invention. Examples of elements that may be suitable in some applications include a perf cut, a score cut and a crease.

Figure 7:
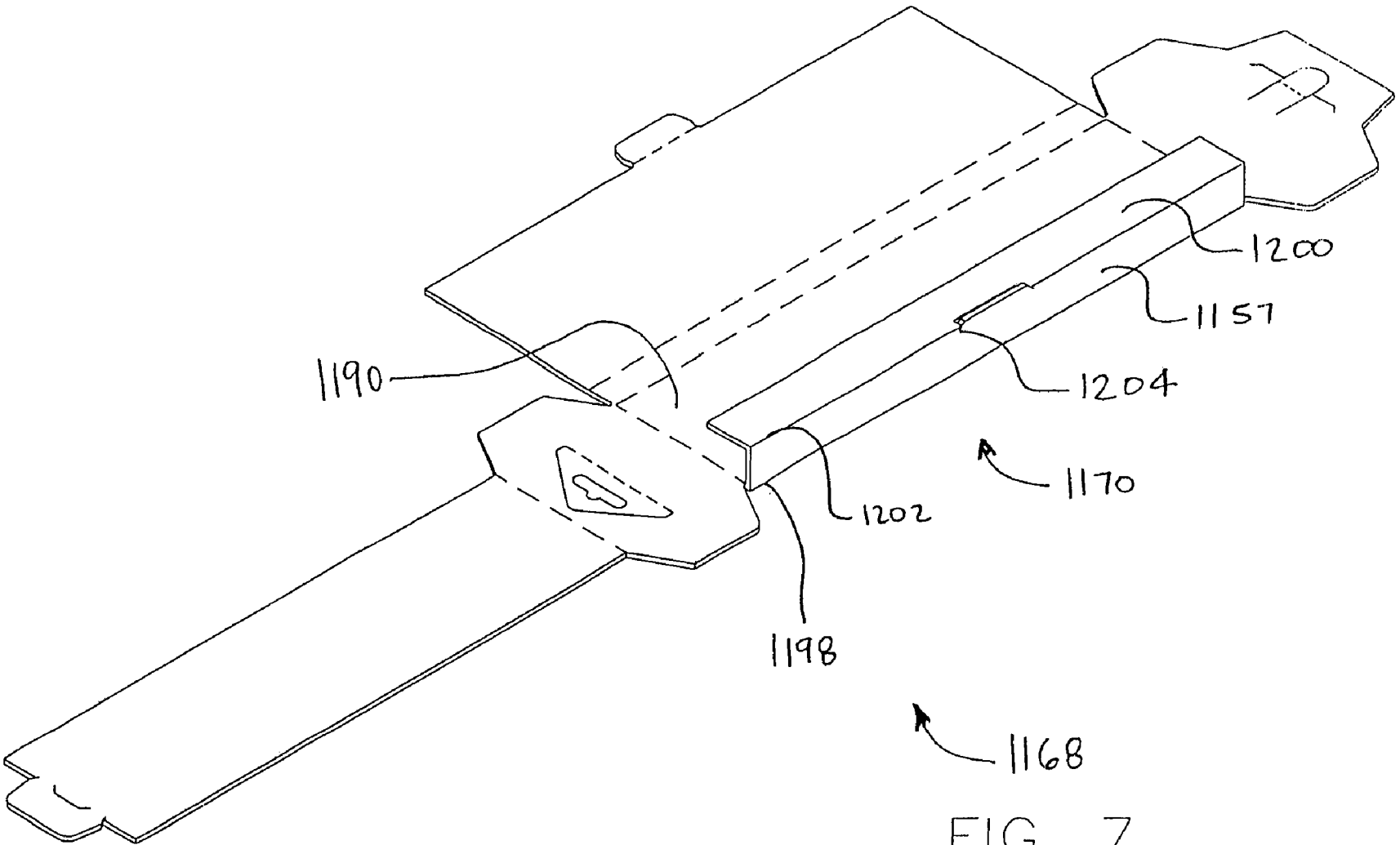
FIG. 7 is another isometric view of blank shown in the previous figure.

FIG. 7 is another isometric view of blank 1168 shown in the previous figure. In the embodiment of FIG. 7, column portion 1170 of blank 1168 is folded along sixth fold line 1198 and seventh fold line 1202. With reference to FIG. 7, it will be appreciated that second side panel 1157 and first major panel 1190 define an angle in the embodiment of FIG. 7. Similarly, second side panel 1157 and column flap 1200 also define an angle in the embodiment of FIG. 7. With reference to FIG. 7, it will be appreciated that third slot 1204 defined by column portion 1170 of blank 1168 is disposed proximate seventh fold line 1202.

Figure 8:
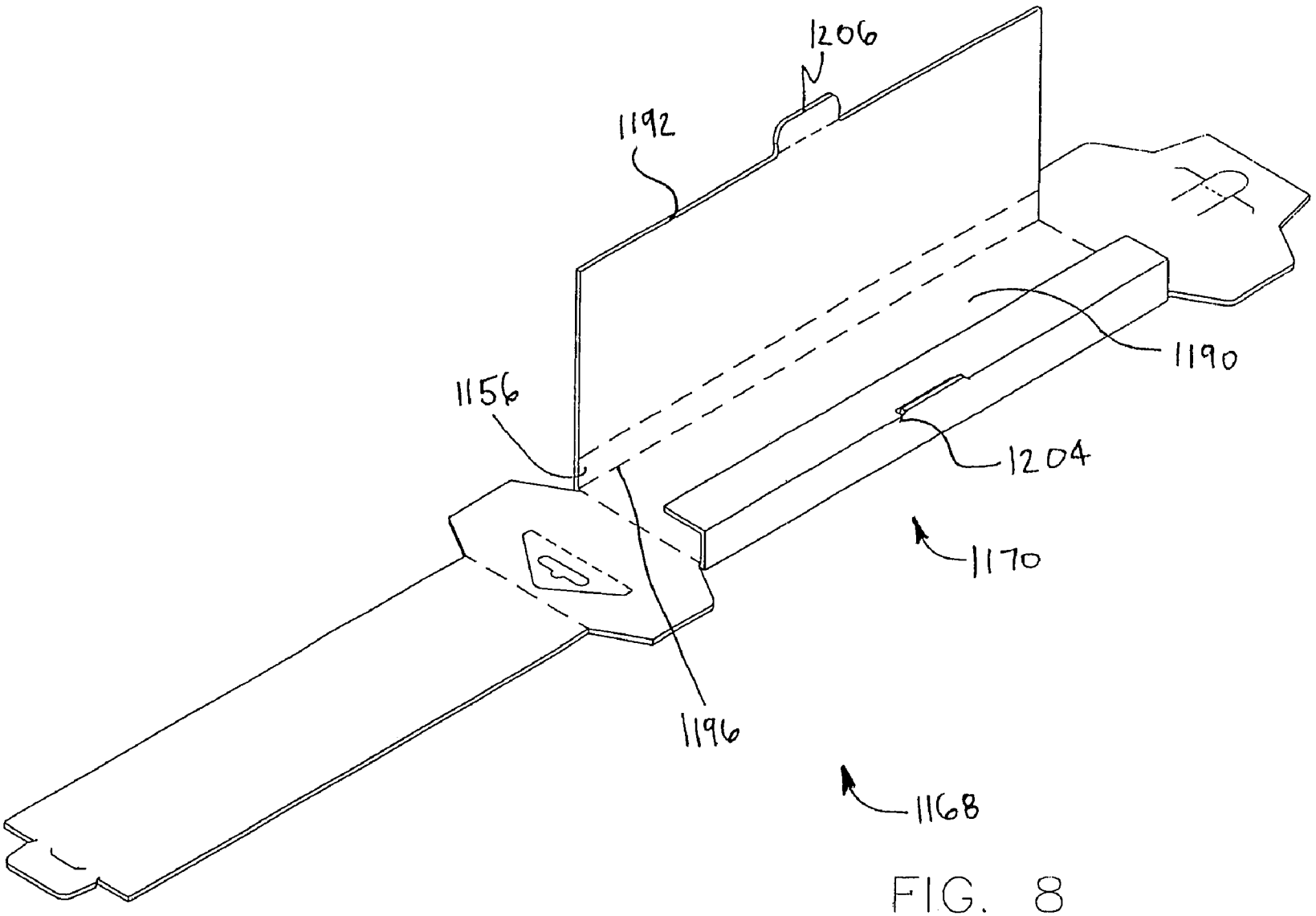
FIG. 8 is an additional isometric view of blank shown in the previous figure.

FIG. 8 is an additional isometric view of blank 1168 shown in the previous figure. In the embodiment of FIG. 8, column portion 1170 of blank 1168 is folded along fifth fold line 1196. With reference to FIG. 8, it will be appreciated that second side panel 1157 and first major panel 1190 define an angle in the embodiment of FIG. 8. With continuing reference to FIG. 8, it will be appreciated that third tab 1206 extends beyond one side of second major panel 1192. In the embodiment of FIG. 8, third tab 1206 and third slot 1204 are dimensioned such that third tab 1206 can be inserted into third slot 1204. Third tab 1206 can be inserted into third slot 1204, for example, when column portion 1170 is folded to form a column.

Figure 9:
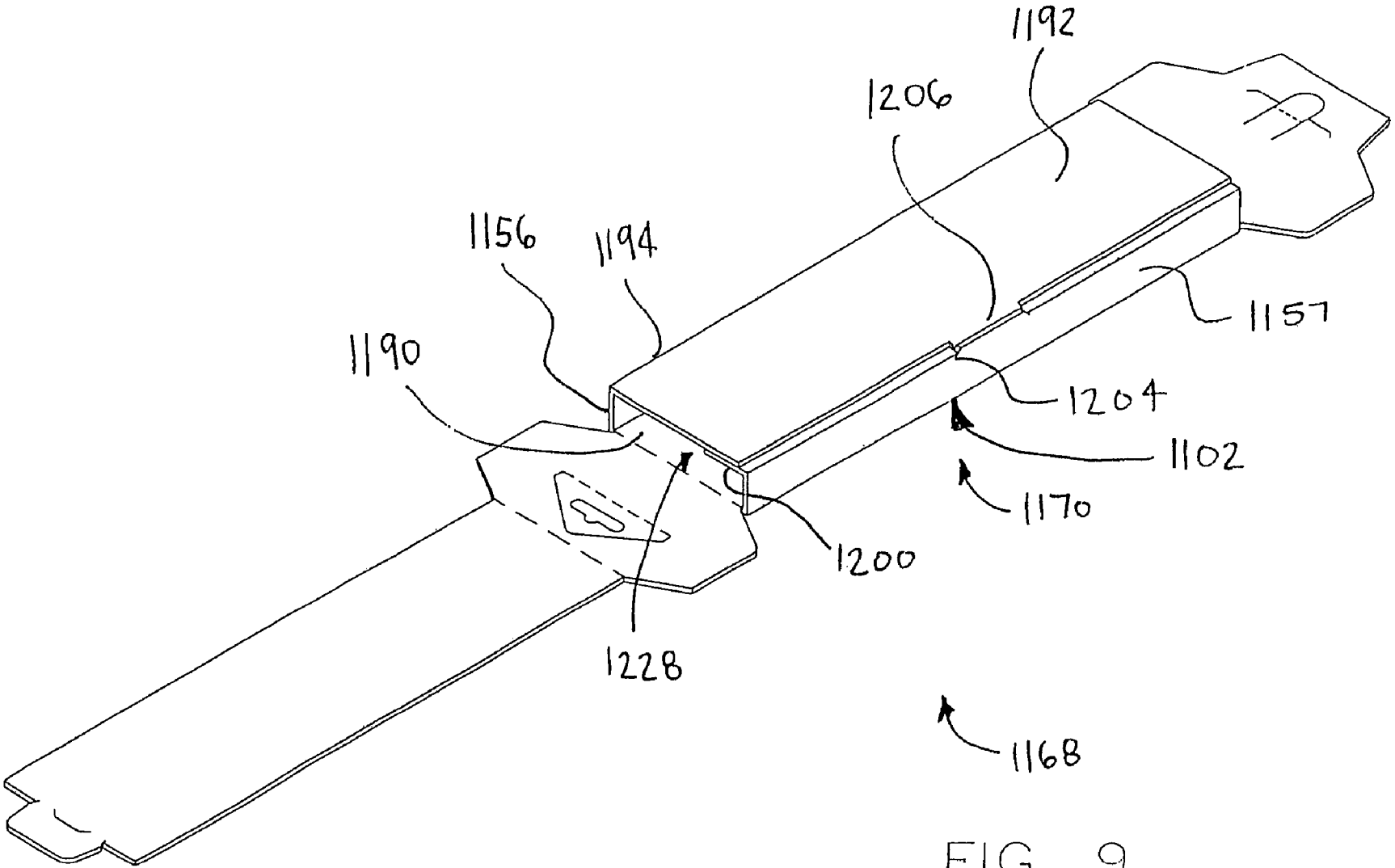
FIG. 9 is yet another isometric view of blank shown in the previous figure.

FIG. 9 is yet another isometric view of blank 1168 shown in the previous figure. In the embodiment of FIG. 9, column portion 1170 of blank 1168 is folded along fourth fold line 1194. In FIG. 9, third tab 1206 is shown extending through third slot 1204. In the embodiment of FIG. 9, first major panel 1190, second major panel 1192, first side panel 1156, second side panel 1157, and column flap 1200 cooperate to form a column 1102.

A cavity 1228 defined by column 1102 is visible in FIG. 9. In some cases, cavity 1228 may be dimensioned to receive and hold literature (e.g., product care instructions) and/or accessories (e.g., extra parts). In the embodiment of FIG. 9, third tab 1206 and third slot 1204 preferably cooperate to retain column portion 1170 of blank 1168 in a column shaped configuration.

Figure 10:
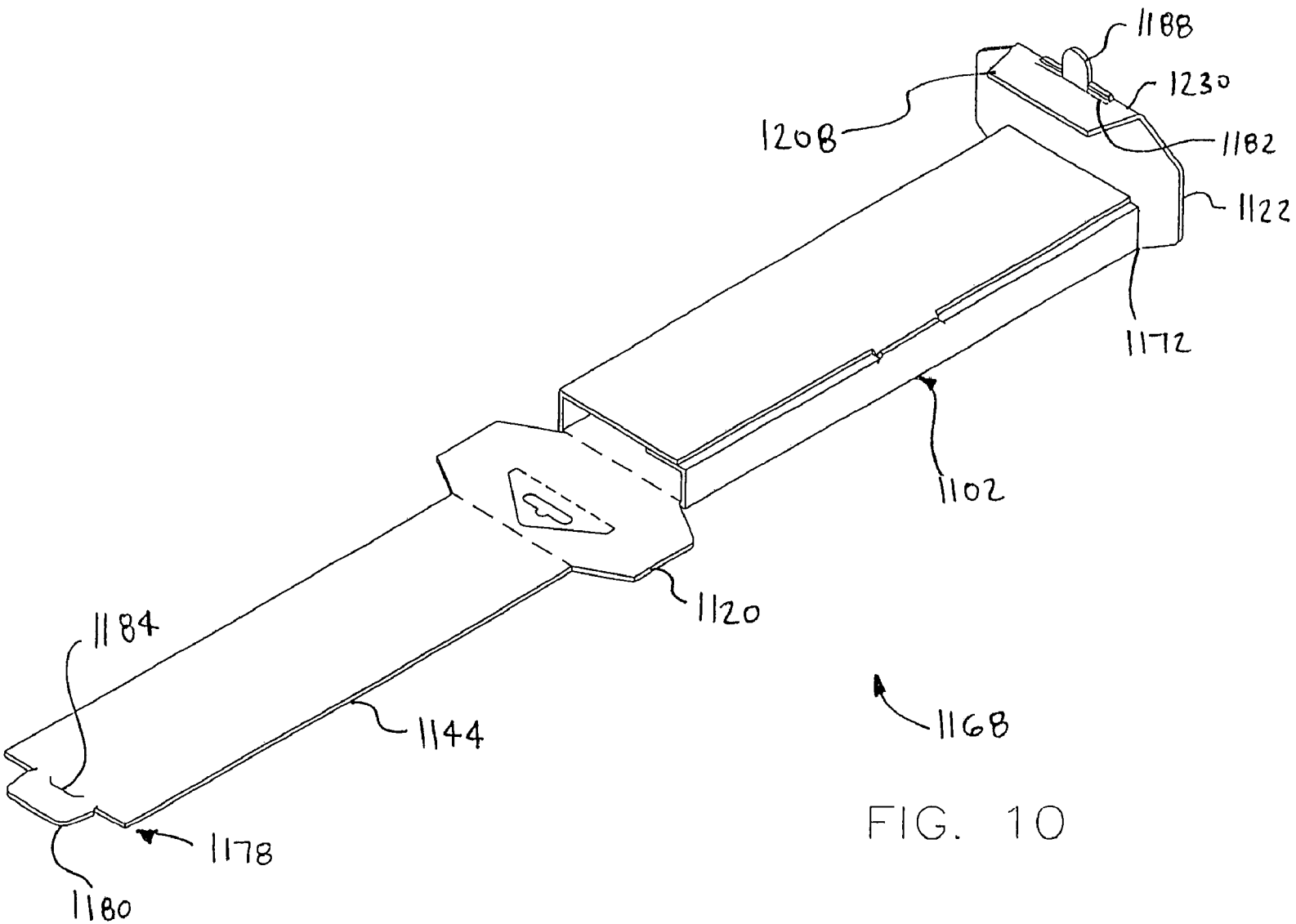
FIG. 10 is still another isometric view of blank shown in the previous figure.

FIG. 10 is still another isometric view of blank 1168 shown in the previous figure. In the embodiment of FIG. 10, blank 1168 is folded along first fold line 1172 and eighth fold line 1230. With reference to FIG. 10, it will be appreciated that bottom panel 1122 and column 1102 define an angle in the embodiment of FIG. 10. Also in FIG. 10, bottom flap 1208 is disposed at an angle relative to bottom panel 1122.

With reference to FIG. 10, it will be appreciated that first slot 1182 defined by bottom panel 1122 of blank 1168 is disposed proximate eighth fold line 1230. In some useful embodiments of the present invention, distal end 1178 of messial panel 1144 can be selectively coupled to bottom panel 1122 so that messial panel 1144, bottom panel 1122 and top panel 1120 form a strap. In FIG. 10, first tab 1180 can be seen disposed proximate distal end 1178 of messial panel 1144. In some useful embodiments of the present invention, first tab 1180 and first slot 1182 are dimensioned such that first tab 1180 can be inserted into first slot 1182.

With reference to FIG. 10, it will be appreciated that messial panel 1144 defines a second slot 1184. A second tab 1188 can be seen extending beyond bottom flap 1208 in FIG. 10. In some useful embodiments of the present invention, second tab 1188 and second slot 1184 are dimensioned so that a portion of second tab 1188 can be inserted into second slot 1184. In the embodiment of FIG. 10, distal end 1178 of messial panel 1144 can be coupled to bottom panel 1122 by inserting first tab 1180 into first slot 1182 and inserting second tab 1188 into second slot 1184. In this manner, a mechanically interlocking connection may be formed. In some applications, a piece of adhesive tape may also be applied to blank 1168 proximate first tab 1180 and second tab 1188.

Figure 11:
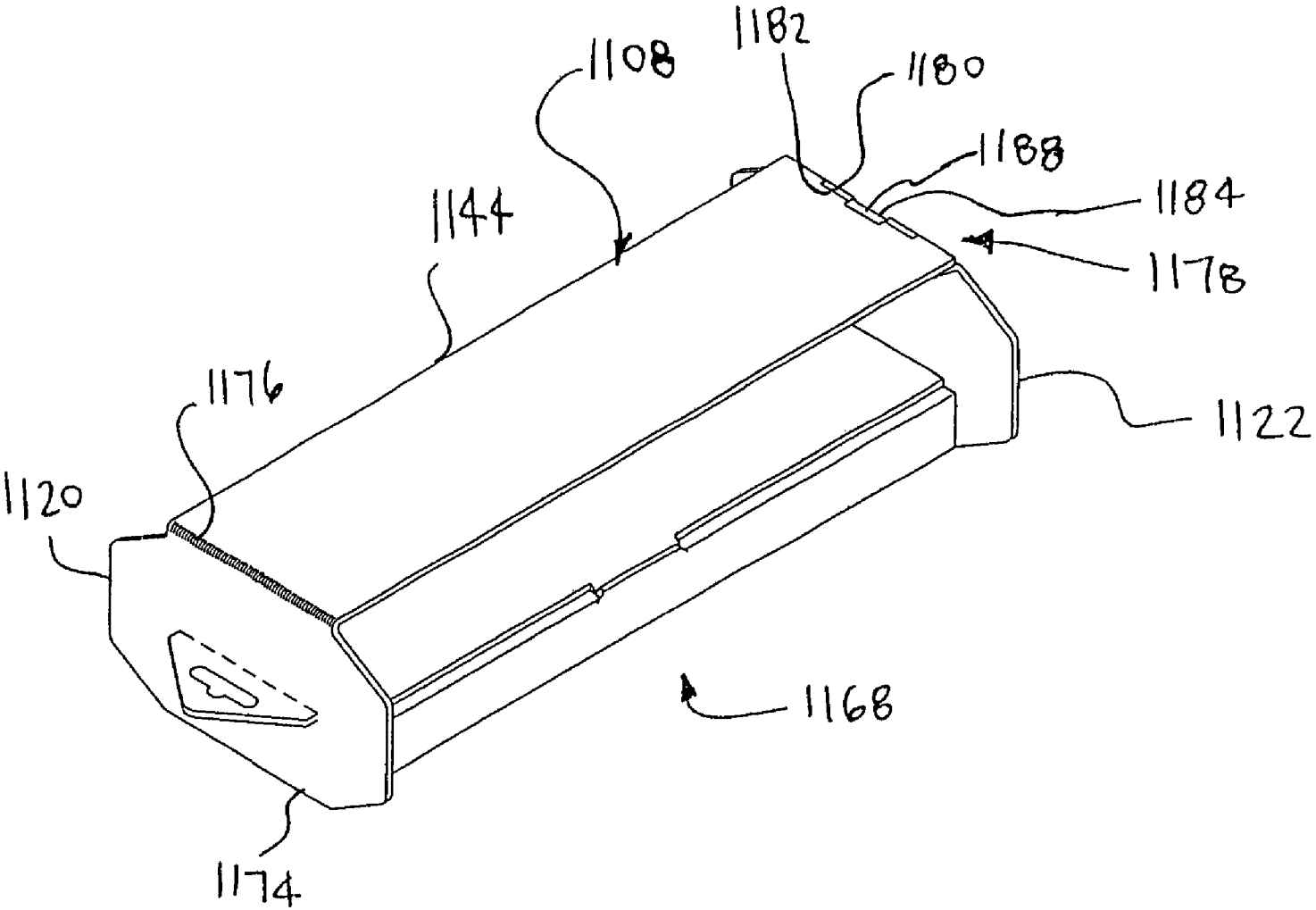
FIG. 11 is an isometric view showing a display apparatus formed from blank shown in the previous figure.

FIG. 11 is an isometric view showing a display apparatus formed from blank 1168 shown in the previous figure. In the embodiment of FIG. 11, blank 1168 is folded along second fold line 1174 and third fold line 1176. With reference to FIG. 11, it will be appreciated that top panel 1120 and column 1102 define an angle in the embodiment of FIG. 11. Also in FIG. 11, messial panel 1144 is disposed at an angle relative to top panel 1120.

In the embodiment of FIG. 11, first tab 1180 is disposed in first slot 1182 and second tab 1188 is disposed in second slot 1184 so that distal end 1178 of messial panel 1144 is coupled to bottom panel 1122. In the embodiment of FIG. 11, bottom panel 1122, messial panel 1144 and top panel 1120 cooperate to form a strap 1108.

Figure 12:
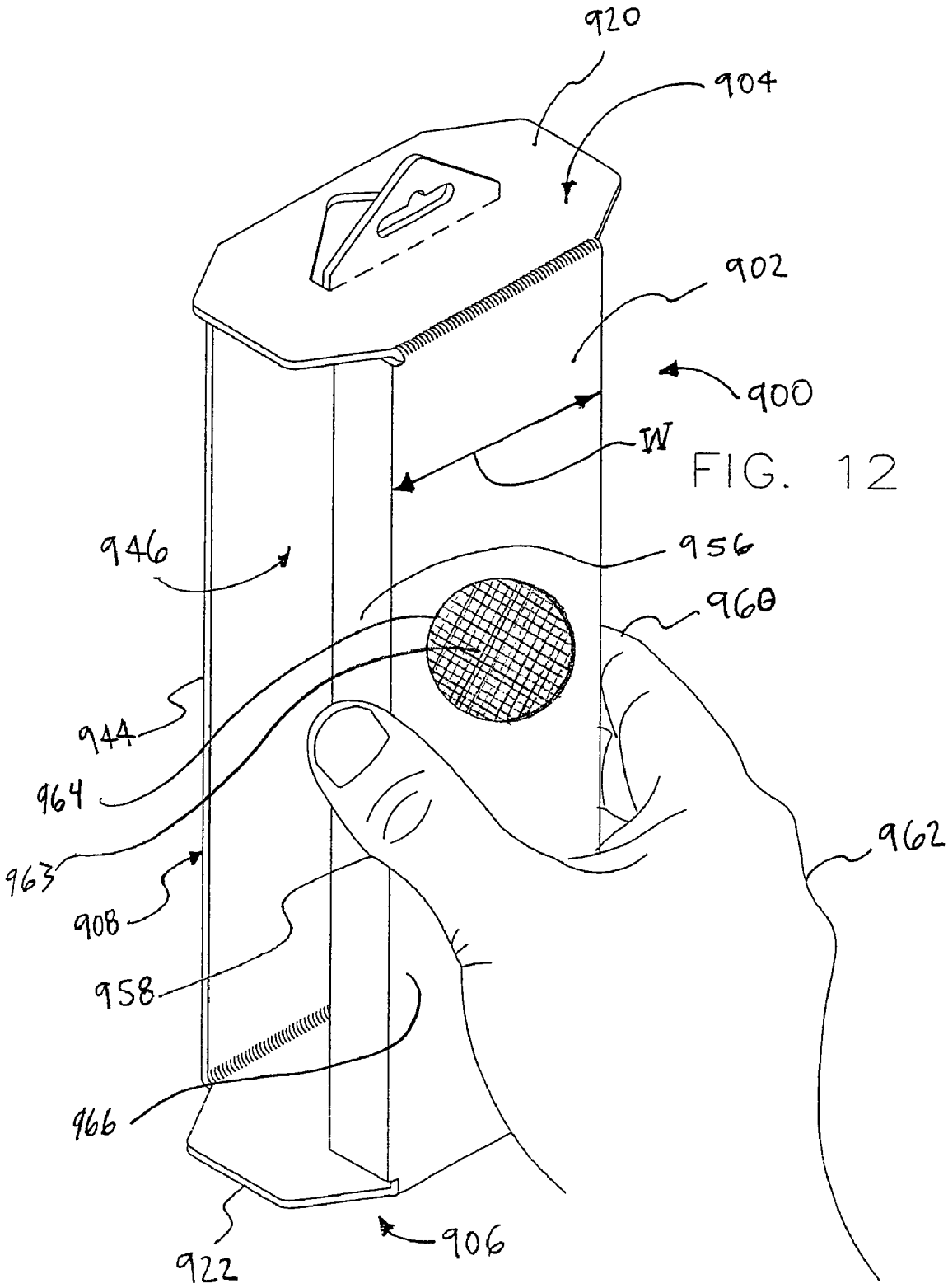
FIG. 12 is an isometric view showing a display apparatus in accordance with an exemplary embodiment of the present invention.

FIG. 12 is an isometric view showing a display apparatus 900 in accordance with an exemplary embodiment of the present invention. Display apparatus 900 comprises a column 902 and a strap 908. In FIG. 12, strap 908 is shown extending between a top end 904 of column 902 and bottom end 906 of column 902. In the embodiment of FIG. 12, column 902 comprises a side panel 956. Also in the embodiment of FIG. 12, strap 908 comprises a top panel 920, a bottom panel 922 and a messial panel 944. With reference to FIG. 12, it will be appreciated that column 902 and strap 908 define an aperture 946 of display apparatus 900. In the embodiment of FIG. 12, column 902 is being gripped between a thumb 958 and a finger 960 of a hand 962.

With reference to FIG. 12, it will be appreciated that side panel 956 of column 902 has sufficient surface area to receive thumb 958 when column 902 is gripped between thumb 958 and finger 960. Column 902 also includes a second side panel (not visible in FIG. 12) that has sufficient surface area to receive one or more finger tips. Column 902 of display apparatus 900 has a width W. With reference to FIG. 12, it will be appreciated that width W of column 902 is selected such that the column can be received the thumb and forefinger of a human hand.

As discussed above, a cavity may be defined by the column (such as cavity 1228 defined by column 1102 in FIG. 9), and may be dimensioned to receive one or more accessories 963. The accessories 963 may include a case adapted to receive the plush item, such as a pillow case adapted to receive a pillow. As shown in FIG. 12, column 902 may define one or more first apertures 964. First apertures 964 may be dimensioned to allow for visual and tactile examination of the accessory 963. First aperture 964 may comprise any size or shape (e.g., circular or rectangular) and may be provided in any suitable location, including in front panel 966, side panel 956, top panel 920, and/or bottom panel 922. In some embodiments, the accessories 963 are disposed within the cavity to allow for visual and tactile examination of the accessories 963 by a consumer through the first aperture 964.

Numerous characteristics and advantages of the invention covered by this document have been set forth in the foregoing description. It will be understood, however, that this disclosure is, in many respects, only illustrative. Changes may be made in details, particularly in matters of shape, size and ordering of steps without exceeding the scope of the invention. The invention's scope is, of course, defined in the language in which the appended claims are expressed.

What is claimed is:

1. A display apparatus, comprising:

a plush item;

a column having a top end and a bottom end and defining a cavity able to receive an accessory, the column defining a first aperture dimensioned to allow for visual and tactile examination of the accessory;

a strap extending between the top end of the column and the bottom end of the column; and the strap and the column defining a second aperture, the second aperture being dimensioned to receive the plush item.

2. The display apparatus of claim 1, wherein the column includes a front panel, the front panel defining the first aperture.

3. The display apparatus of claim 1, wherein the first aperture comprises a generally circular shape.

4. The display apparatus of claim 1, wherein a width of the column is selected such that a first uncovered portion of the plush item will extend beyond a first side of the column and a second uncovered portion of the plush item will extend beyond a second side of the column when the plush item is extending through the second aperture.

5. The display apparatus of claim 4, wherein the width of the column is selected such that a surface area of the first uncovered portion is greater that a surface area of the plush item that is covered by the column when the plush item is extending through the second aperture.

6. The display apparatus of claim 4, wherein the width of the column is selected such that a surface area of the second uncovered portion is greater that a surface area of the plush item that is covered by the column when the plush item is extending through the second aperture.

7. The display apparatus of claim 1, wherein the second aperture is dimensioned to receive the plush item while the plush item is assuming a compressed shape.

8. The display apparatus of claim 7, wherein the second aperture is dimensioned such that friction forces are created between the display apparatus and the plush item when the plush item is extending through the aperture and the plush item is free to assume an expanded shape.

9. A display apparatus, comprising:

a plush item;

a column having a top end and a bottom end and defining a cavity able to receive an accessory, the column defining a first aperture dimensioned to allow for visual and tactile examination of the accessory;

a strap extending between the top end of the column and the bottom end of the column;

the strap and the column defining a second aperture, the second aperture being dimensioned to receive the plush item; and wherein the plush item comprises a pillow and the accessory comprises a pillow case adapted to receive the pillow.

10. A combination comprising:

a display apparatus comprising a column defining a cavity and a first aperture, and a strap extending between a top end of the column and a bottom end of the column, the strap and the column defining a second aperture;

a plush item extending through the second aperture; and an accessory disposed within the cavity.

11. The combination of claim 10, wherein a first uncovered portion of the plush item extends beyond a first side of the display apparatus and a second uncovered portion of the plush item extends beyond a second side of the display apparatus.

12. The combination of claim 11, wherein the column covers a covered portion of the plush item.

13. The combination of claim 12, wherein an area of the first uncovered portion is greater than an area of the covered portion.

14. The combination of claim 12, wherein an area of the second uncovered portion is greater than an area of the covered portion.

15. The combination of claim 10, wherein friction at one or more interfaces between the plush item and the display apparatus sufficient to support a weight of the plush item.

16. A combination comprising:

a display apparatus comprising a column defining a cavity and a first aperture, and a strap extending between a top end of the column and a bottom end of the column, the strap and the column defining a second aperture;

a plush item extending through the second aperture;

an accessory disposed within the cavity; and wherein the plush item comprises a pillow.

17. The combination of claim 16, wherein the accessory comprises a pillow case adapted to receive the pillow.

18. A combination comprising:

a display apparatus comprising a column defining a cavity and a first aperture, and a strap extending between a top end of the column and a bottom end of the column, the strap and the column defining a second aperture;

a plush item extending through the second aperture;

an accessory disposed within the cavity; and wherein the column includes a front panel, the front panel defining the first aperture.

19. A combination comprising:

a display apparatus comprising a column defining a cavity and a first aperture, and a strap extending between a top end of the column and a bottom end of the column, the strap and the column defining a second aperture;

a plush item extending through the second aperture;

an accessory disposed within the cavity; and

Where the first aperture comprises a generally circular shape.

20. A combination comprising:

a display apparatus comprising a column having a front panel, a side panel, a top panel, and a bottom panel defining a cavity, the front panel defining a first aperture, and a strap extending between a top end of the column and a bottom end of the column, the strap and the column defining a second aperture;

a pillow extending through the second aperture; and a pillow case disposed within the cavity, the first aperture dimensioned to allow for visual and tactile examination of the pillow case disposed within the cavity.

* * * * *